US010408400B2

(12) United States Patent
Vannieuwenhuyse et al.

(10) Patent No.: US 10,408,400 B2
(45) Date of Patent: Sep. 10, 2019

(54) BEACON DEVICE FOR INSTALLATION ON A TOWER AND ASSOCIATED INSTALLATION METHOD

(71) Applicant: ARMOR, Nantes (FR)

(72) Inventors: Nicolas Vannieuwenhuyse, La Haye Fouassière (FR); David Loureiro, Nantes (FR); Amaury Martin, Saint Philbert de Grand Lieu (FR); Christophe Derennes, Saint Philbert de Grand Lieu (FR)

(73) Assignee: ARMOR, Nantes (FR)

( * ) Notice: Subject to any disclaimer, the term of this patent is extended or adjusted under 35 U.S.C. 154(b) by 136 days.

(21) Appl. No.: 15/529,596

(22) PCT Filed: Nov. 27, 2015

(86) PCT No.: PCT/EP2015/077949
§ 371 (c)(1),
(2) Date: May 25, 2017

(87) PCT Pub. No.: WO2016/083590
PCT Pub. Date: Jun. 2, 2016

(65) Prior Publication Data

US 2017/0261165 A1 Sep. 14, 2017

(30) Foreign Application Priority Data

Nov. 28, 2014 (FR) ..... 14 61683

(51) Int. Cl.
*F21S 9/03* (2006.01)
*F21V 21/116* (2006.01)
(Continued)

(52) U.S. Cl.
CPC ..... *F21S 9/037* (2013.01); *F21S 9/035* (2013.01); *F21V 15/01* (2013.01); *F21V 21/116* (2013.01);
(Continued)

(58) Field of Classification Search
CPC . F21S 9/035; F21S 9/037; E01F 9/617; B61L 5/18; F21V 21/35
See application file for complete search history.

(56) References Cited

U.S. PATENT DOCUMENTS 4,062,371 A * 12/1977 Bolen ..... A45B 3/04 135/66
6,060,658 A * 5/2000 Yoshida ..... F21S 8/086 136/243
(Continued)

FOREIGN PATENT DOCUMENTS

EP 1884711 A1 2/2008
WO 2013093402 A2 6/2013

OTHER PUBLICATIONS

Search Report for FR 1461683 dated Oct. 2, 2015.
International Search Report for PCT/EP2015/077949 dated Dec. 23, 2015.

*Primary Examiner* — Alexander K Garlen
*Assistant Examiner* — Eric T Eide
(74) *Attorney, Agent, or Firm* — Pearne & Gordon LLP

(57) ABSTRACT

A beacon device to be installed on a tower, the device including: an electric energy generating unit comprising: at least one photovoltaic module able to be wound over at least part of the circumference of the tower, and a light energy generating unit configured to be fastened on the tower the light energy generating unit comprising: a housing having a periphery, a storage member storing the electric energy generated by the electric energy generating unit, a regulating member regulating the charge of the storage member, and a
(Continued)

Figure 1:
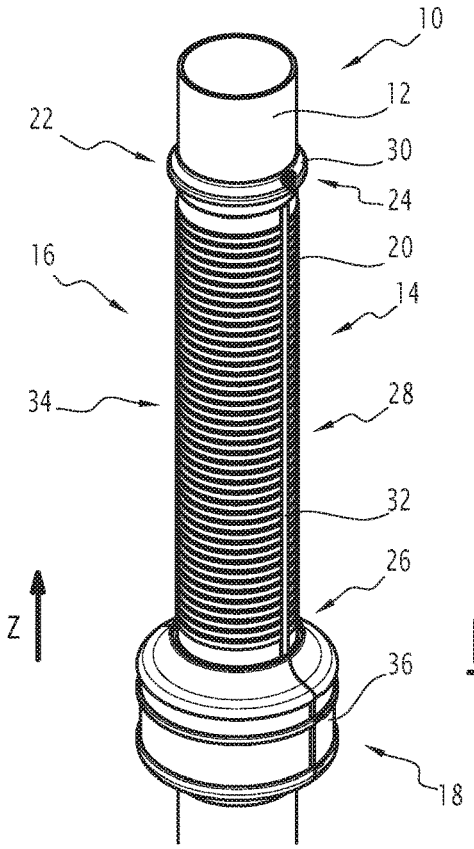

light-emitting member supplied by the storage member, the light-emitting member extending over the periphery of the housing.

17 Claims, 6 Drawing Sheets

(51) Int. Cl.
*F21V 15/01* (2006.01)
*F21W 111/00* (2006.01)
*F21Y 115/10* (2016.01)

(52) U.S. Cl.
CPC ..... *F21W 2111/00* (2013.01); *F21Y 2115/10* (2016.08)

(56) References Cited

U.S. PATENT DOCUMENTS

| | | | | |
|---|---|---|---|---|
| 6,682,204 | B2 | 1/2004 | Mullally et al. | |
| 2009/0211621 | A1* | 8/2009 | LeBlanc | H01L 31/0392 136/244 |
| 2009/0244881 | A1 | 10/2009 | Butler | |
| 2010/0029268 | A1 | 2/2010 | Myer et al. | |
| 2013/0265786 | A1* | 10/2013 | Quinzi | F21S 8/085 362/431 |
| 2013/0322063 | A1* | 12/2013 | Tittle | F21S 8/086 362/183 |
| 2013/0327913 | A1* | 12/2013 | Fruhm | A63J 1/00 248/349.1 |
| 2014/0360559 | A1* | 12/2014 | Braghiroli | F21S 8/086 136/251 |

* cited by examiner

BEACON DEVICE FOR INSTALLATION ON A TOWER AND ASSOCIATED INSTALLATION METHOD

This is a National Stage application of PCT international application PCT/EP2015/077949, filed on Nov. 27, 2015 which claims the priority of French Patent Application No. 14 61683 entitled "Beacon device for installation on a tower and associated installation method", filed Nov. 28, 2014, both of which are incorporated herein by reference in their entirety.

The present invention relates to a beacon device for installation on a tower. The invention also relates to a beacon system comprising such a beacon device and a method for installing the beacon device.

Multiple forms exist for the towers. In general, a tower is cylindrical, the base surface being able to have any shape. As an example, the base surface is a circle, a square, an oval or any other shape.

It is therefore desirable to propose a beacon system able to attach on the tower irrespective of the shape of the tower.

To that end, known from document U.S. Pat. No. 6,682,204 is a mechanism for mounting a lighting unit able to adapt to any type of tower.

However, such a device has the drawback of being difficult to implement because it is necessary to provide for the passage of power cables before the insertion of the lighting unit.

There is therefore a need for a beacon device to be installed on a tower that is easier to implement.

To that end, a lighting device is proposed, in particular a beacon device, to be installed on a tower. The device includes an electric energy generating unit the comprising at least one photovoltaic module able to be wound over at least part of the circumference of the tower, preferably over the entire circumference of the tower. The device also includes a light energy generating unit configured to be fastened on the tower, the light energy generating unit comprising a housing having a periphery, a member for storing the electric energy generated by the electric energy generating unit, a member for regulating the charge of the storage member, and a light-emitting member powered by the storage member, the light-emitting member extending over the periphery of the housing.

According to specific embodiments, the lighting device comprises one or more of the following features, considered alone or according to any technically possible combinations:

- the housing comprises the storage member and the regulating member.
- the housing has a recess with a shape complementary to the tower.
- the housing has two parts, the second part being connected to the first part.
- the housing has two parts, each part comprising an electric track portion, the two track portions forming a continuous track when the second part is connected to the first part.
- the electric energy generating unit includes a support keeping the photovoltaic module wound over at least part of the circumference of the tower, preferably over the entire circumference of the tower.
- the support comprises a ring and two maintaining elements connecting the ring to the light energy generating unit, the two maintaining elements being diametrically opposite one another.

The invention also relates to a beacon system comprising a tower, and a device as previously described installed on the tower.

The invention also relates to a beacon system comprising a tower, at least one electric energy generating unit the comprising at least one photovoltaic module able to be wound over at least part of the circumference of the tower, preferably over the entire circumference of the tower. The beacon system includes at least one light energy generating unit fastened on the tower, each light energy generating unit comprising a housing having a periphery, a member for storing the electric energy generated by at least one electric energy generating unit, a member for regulating the charge of the storage member, and a light-emitting member powered by the storage member, the light-emitting member extending over the periphery of the housing.

Furthermore, the invention also relates to a method for installing a device as previously described on a tower, comprising the steps of winding the photovoltaic module on the tower, and assembling the housing on the photovoltaic module.

Figure 2:
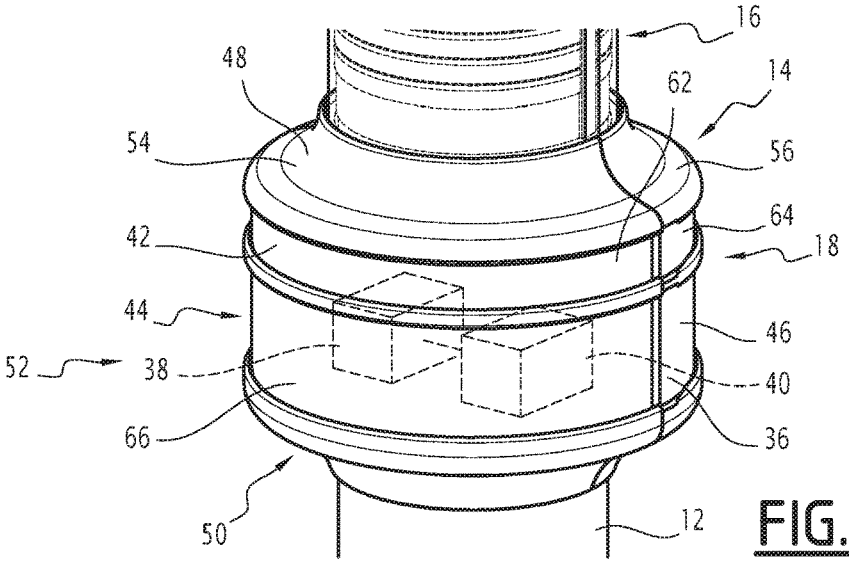
Figure 3:
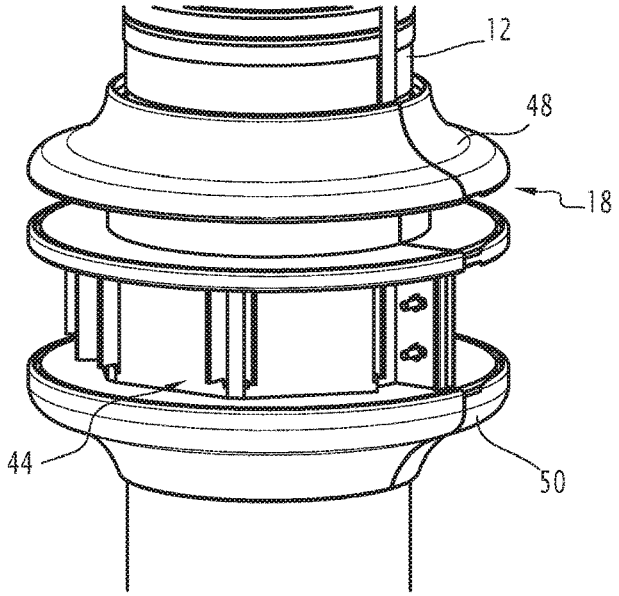
Figure 4:
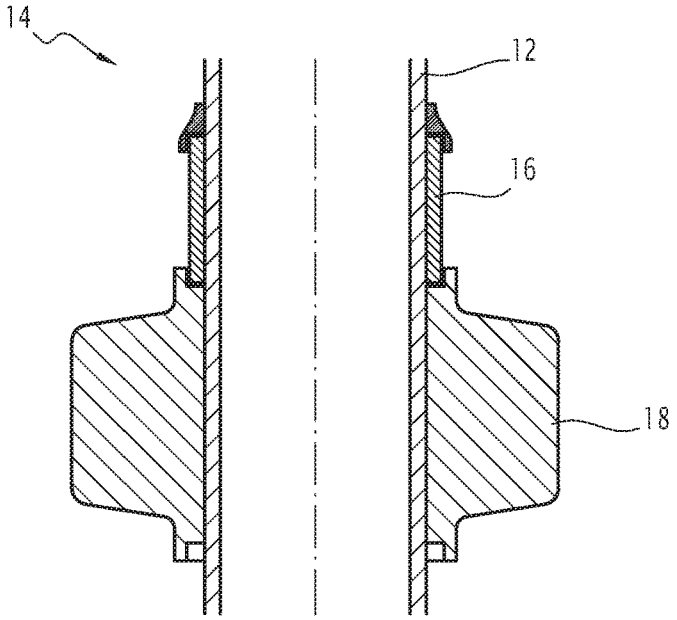
Figure 5:
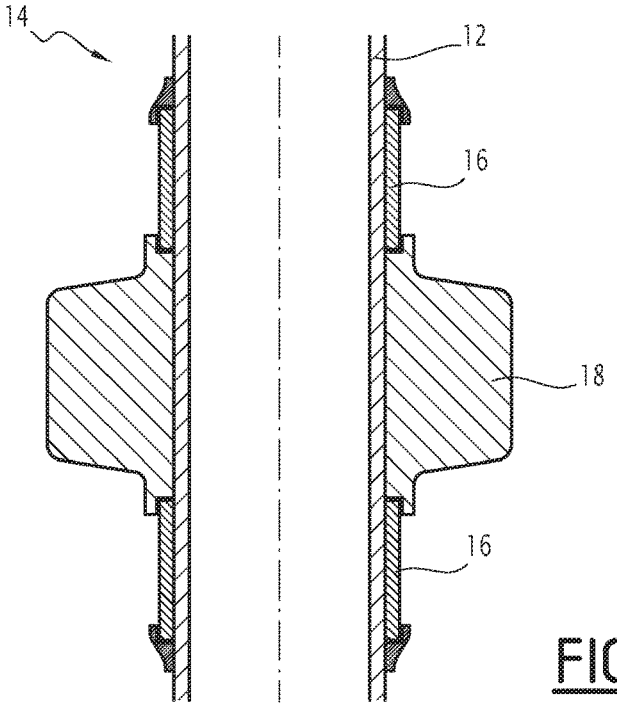
Figure 6:
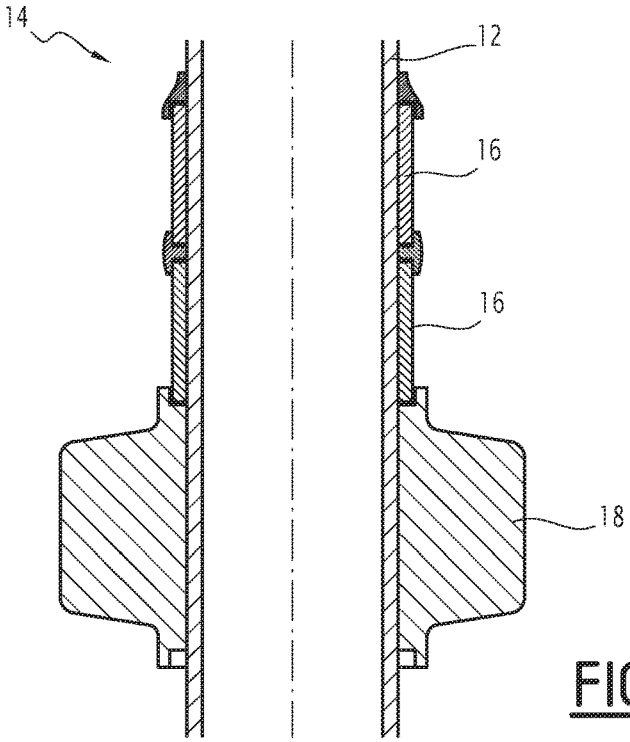
Figure 7:
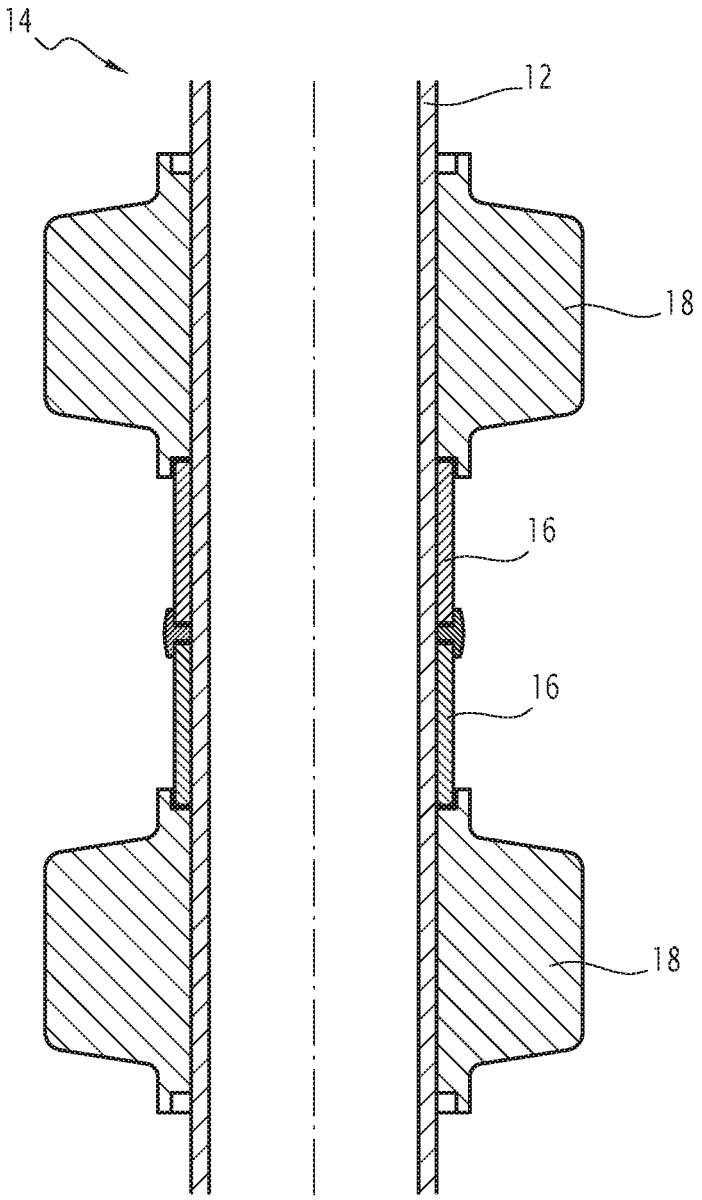
Figure 8:
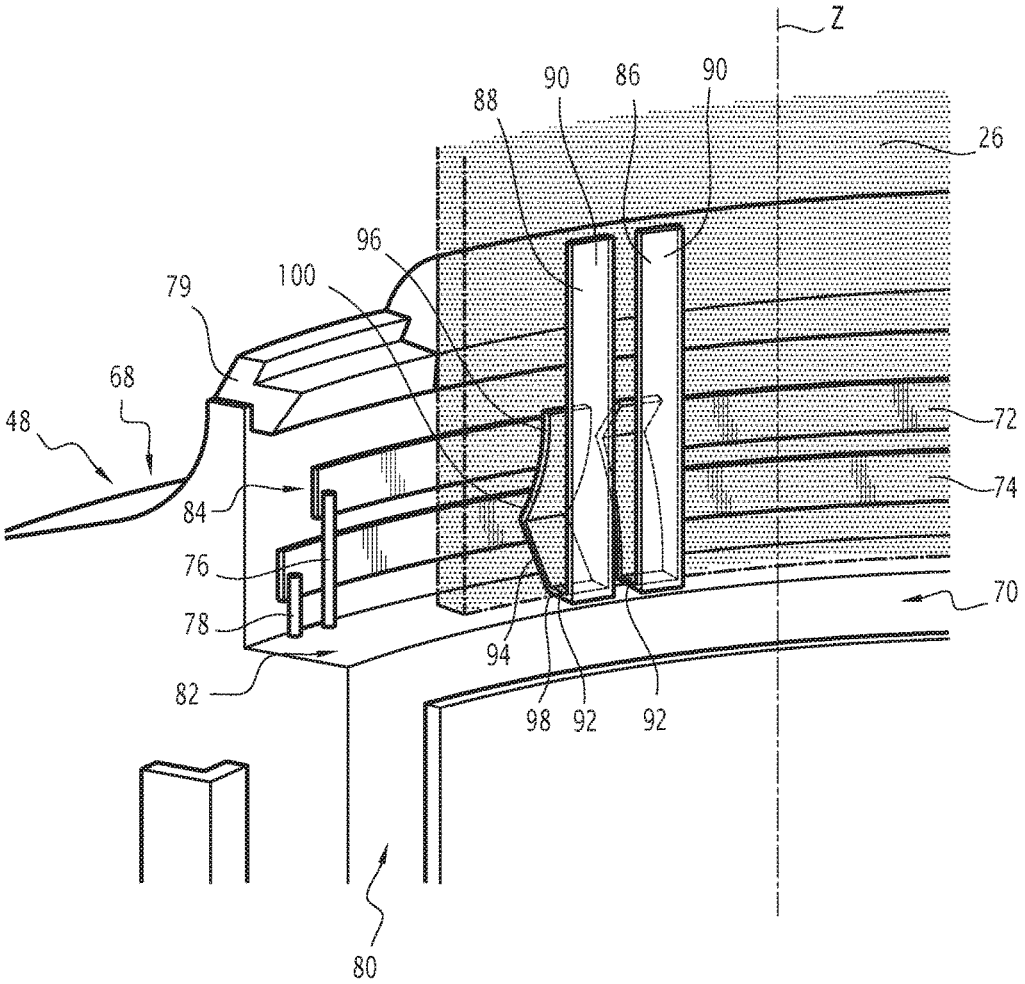
Figure 9:
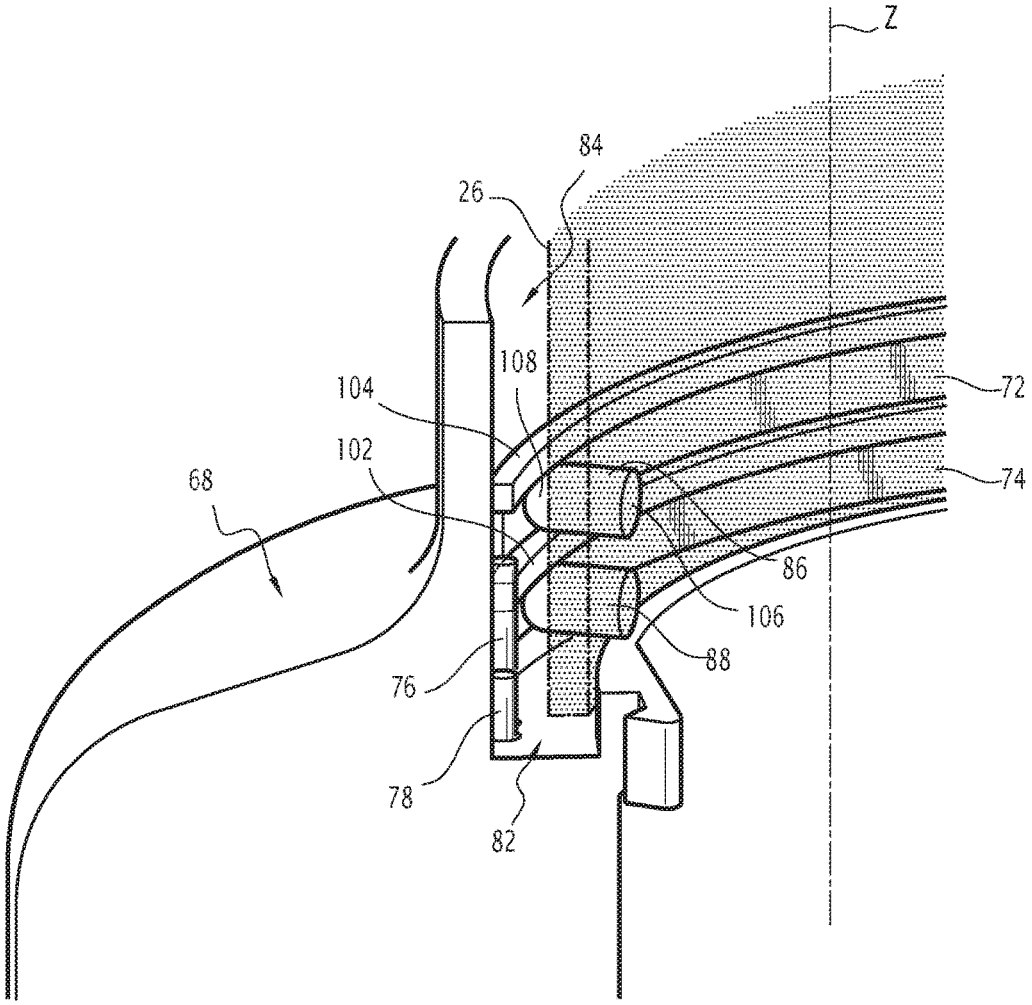

Other features and advantages of the invention will appear upon reading the following description of one embodiment of the invention, provided as an example only and in reference to the drawings, which are:

FIG. 1, a view of a beacon system including a part of the tower and a beacon device according to a first embodiment installed on the tower, FIG. 2, an enlarged view of a part of FIG. 1, FIG. 3, a view of the housing visible in FIG. 2 without the elements placed on top, FIG. 4, a sectional view of the system according to FIG. 1, FIG. 5, a sectional view of another example beacon system, FIG. 6, a sectional view according to still another example beacon system, FIG. 7, a sectional view of an example of a sectional view of another beacon system, FIG. 8, a sectional view of another example beacon system, and FIG. 9, a sectional view of another example beacon system.

A beacon system 10 is shown in FIG. 1.

In air, rail, water, road or pedestrian traffic, beaconing refers to the set of stationary or floating marks or beacons placed to signal a danger or indicate the path to be followed using all means, in particular lighted means.

The term beaconing thus refers to a way of indicating the presence of information owing to an integrated diffuse light source, making it possible to improve the contrast of the display of the piece of information and to thus ensure good readability, even in a dark or poorly lit location.

The beaconing system 10 is therefore able to indicate a specific location, a location corresponding to a risk, an access point or specific information.

The beaconing system 10 includes a tower 12 and a beacon device 14 installed on the tower 12.

The tower 12 is a cylinder.

By definition, a cylinder is a solid defined by a cylindrical surface and two strictly parallel planes. The cylindrical surface is a surface in space defined by a straight line, called generatrix, passing through a variable point describing a closed planar curve, called guide curve and keeping a fixed direction. The surface defined by the guide curve is called base of the cylinder hereinafter.

According to the example of FIG. 1, the generatrix extends along a so-called axial direction. In FIG. 1, the axial direction is symbolized by an axis Z.

Furthermore, the base of the tower 12 may have any shape.

In the case of FIG. 1, the base of the tower 12 is disc-shaped.

The diameter of the base of the tower 12 is for example comprised between 70 mm (millimeters) and 300 mm.

Alternatively, the base of the tower 12 is oval.

According to still another alternative, the base of the tower 12 is a rectangle, a square, a triangle or a polygon having more than four sides. A pentagon or a hexagon are examples of polygons with more than four sides.

Alternatively, the tower 12 is conical.

By definition, a cone is a solid defined by a plane and by a straight line, called generatrix, passing through a fixed point called apex and a variable point describing a curve called guide curve, the plane not containing the apex and being secant to all of the generatrices.

According to the example of FIG. 1, the tower 12 is hollow, i.e., the tower 12 is in the form of a tube defining an empty inner space.

The beacon device 14 is able to light the environment, the tower 12 serving as a support for the beacon device 14.

According to one particular example, the beacon device 14 is able to emit lighted information.

Alternatively, the beacon device 14 is intended to show a piece of visual information, for example to indicate a route.

According to one example, the beacon device 14 is intended to show a specific piece of information.

Alternatively, the beacon device 14 is intended to provide a warning of the presence of a danger.

The beacon device 14 includes an electric energy generating unit 16 and a light energy generating unit 18. For simplification reasons, hereinafter, the electric energy generating unit is simply called electric unit 16, while the light energy generating unit 18 is called light unit 18.

The electric unit 16 is able to generate electricity to power the light unit 18.

The electric unit 16 includes a photovoltaic module 20 and a support 22 maintaining the photovoltaic module 20 on the tower 12.

By definition, a photovoltaic module is a photovoltaic solar sensor or photovoltaic solar panel. Furthermore, a photovoltaic module is a DC electric generator including a set of photovoltaic cells electrically connected to one another, the module serving to supply electricity from solar energy.

According to the example of FIG. 1, the photovoltaic module 20 is an organic-type photovoltaic module. This means that the photovoltaic module includes particular photovoltaic cells, at least the active layer of which is made up of organic molecules. As a result, the photovoltaic effect is, for a photovoltaic cell, obtained using the properties of semiconductor materials.

A semiconductor is considered to be organic when the semiconductor comprises at least one bond belonging to the group made up of covalent bonds between a carbon atom and a hydrogen atom, covalent bonds between a carbon atom and a nitrogen atom, or bonds between a carbon atom and an oxygen atom.

An organic photovoltaic module is an assembly comprising at least two individualized photovoltaic cells adjacent to one another and connected in series or in parallel. The formation of an organic photovoltaic module involves depositing patterns of superimposed film strips on a substrate.

A film is a homogenous and continuous layer made from a material or a mixture of materials having a relatively small thickness. A relatively small thickness refers to a thickness smaller than or equal to 500 microns.

For example, the formation of a photovoltaic module involves strips having a width comprised between 9.5 mm and 13.5 mm separated by an inter-band zone with a width comprised between 0.5 mm and 4.5 mm, the total width of the band and the inter-band zone being 14 mm. A module is made up of the deposition of several layers using different coating or printing methods.

Using an organic photovoltaic module makes it possible to have a relatively thin energy generator; relatively thin refers to a thickness smaller than or equal to 500 microns or even smaller than or equal to 300 microns, causing a low weight, a possibility of customization of its size by cutting, and a mechanical flexibility allowing instantaneous adaptation of the module to the integration context.

Alternatively, the photovoltaic module 20 is a flexible module made from amorphous silicon.

According to the example of FIG. 1, the photovoltaic module 20 is furthermore able to be wound around at least part of the circumference of the tower 12. The circumference of the tower 12 corresponds to the cylindrical surface of the tower 12.

Preferably, as in the particular case of FIG. 1, the photovoltaic module 20 is wound over the entire circumference of the tower 12.

The cells of the photovoltaic module 20 are positioned perpendicular to the vertical axis Z, i.e., to the horizontal, so that it is not completely shaded when the light source (usually the sun) moves over the course of the day, thereby allowing a continuous supply of the device 14.

This makes it possible to collect light in all directions. Thus, contrary to nonflexible technologies, there is no need to use a sun tracker for the photovoltaic module 20 to receive light throughout the entire day.

The dimensions of the photovoltaic module 20 determine the electrical performance of the photovoltaic module 20. As a result, the dimensions of the photovoltaic module 20 are determined based on the energy needs of the light source 18, and the mean radiation on the geographical site where the device 14 is installed.

For example, for a light unit 18 having a daily consumption of 5 Watts per hour, the mean energy production of the photovoltaic module 20 is considered to be at least twice the energy need of the light source 18 in order to ensure that the need is met even on days with the lowest irradiance, i.e., 10 Watts per hour. For example, for electrical performance levels of the photovoltaic module 20 of 60 peak Watts/$m^2$, it may be determined that a dimension of 600 mm along the axial direction Z meets the desired energy need.

When the photovoltaic module 20 is wound around the tower 12, the photovoltaic module 20 defines a zone, on the tower 12, having a dimension comprised between 10 mm and 1 meter along the axial direction Z.

According to the example of FIG. 1, the zone defined by the photovoltaic module 20 on the tower 12 has a dimension of 600 mm along the axial direction Z.

For example, it is possible to consider using a photovoltaic module whose dimensions are about 600 mm by 450 mm.

Subsequently, for the photovoltaic module 20, a distal end 24 and a proximal end 26 are defined, the distal end 24 being the end furthest from the light unit 18.

In the particular case of FIG. 1, each of the ends 24 and 26 corresponds to a curve (in the case at hand, a circle) on the tower 12.

The support 22 is able to keep the photovoltaic module 20 wound over at least part of the circumference of the tower 12, and preferably over the entire circumference of the tower 12, as shown in FIG. 1.

The support 22 includes a protective wall 28 able to protect the photovoltaic module 20, a ring 30 and two maintaining elements 32, 34.

The protective wall 28 is able to isolate the photovoltaic module 20 from the outside. In particular, the protective wall 28 is able to protect the photovoltaic module 20 from bad weather that could damage the photovoltaic module 20.

According to the example of FIG. 1, the protective wall 28 covers the entire photovoltaic module 20 so as to form a covering layer positioned on the photovoltaic module 20.

Furthermore, according to the specific illustrated case, the protective wall 28 assumes the form of a film.

As an example and non-exhaustively, the protective wall 28 is made from a material chosen from among polymethyl methacrylate (PMMA), glass or transparent resin.

The ring 30 is able to act as a gripping or finishing ring.

The ring 30 is situated at the distal end 26 of the photovoltaic module 20.

The ring 30 extends in a plane perpendicular to the axial direction Z. Such a plane is described as radial plane in the continuation of the description.

The ring 30 is in the shape of a circle.

According to the example of FIG. 1, the ring 30 is made from plastic.

According to another embodiment, the ring 30 is made from metal, in particular steel or aluminum.

Alternatively, the ring 30 is made from a flexible material, such as rubber or a resin.

The two maintaining elements 32, 34 are able to connect the ring 30 to the light unit 18.

Furthermore, the two maintaining elements 32, 34 are able to perform a sealing function of the protective wall 28.

According to the example of FIG. 1, the two maintaining elements 32, 34 extend between the distal end 26 of the photovoltaic module 20 and the proximal end of the photovoltaic module 20.

As shown in FIG. 1, the two maintaining elements 32, 34 are rectilinear.

Furthermore, the two maintaining elements 32, 34 are diametrically opposite relative to the tower 12.

For example, each of the two maintaining elements 32, 34 is made from a flexible material. Typically, it is possible to consider a rubber or a silicone seal.

The light unit 18 is configured to be fastened on the tower 12.

The light unit 18 is able to perform a lighting function for the environment of the tower 12.

The light unit 18 is also able to perform an electric energy management and electric energy storage function.

The light unit 18 includes a housing 36, a storage member 38, a regulating member 40 and a light-emitting member 42.

In FIG. 2, the storage member 38 and the regulating member 40 are shown in dotted lines, and, for readability reasons, positioned at the middle of the housing 36. One skilled in the art will understand that the position illustrated in FIG. 2 is purely schematic, the storage member 38 and the regulating member 40 being around the tower 12.

The housing 36 includes a body 44, a protective wall 46, the storage member 38 and the regulating member 40.

The body 44 has an upper part 48, a lower part 50 and a median part 52 defined by the upper part 48 and the lower part 50.

The median part 52 is in the shape of a cylinder with a circular base. The generatrix of the cylinder extends over a height of at least 150 mm, preferably comprised between 150 mm and 250 mm. Preferably, the height of the generatrix of the cylinder is equal to 200 mm.

The body 44 has two parts, a first part 54 and a second part 56.

Preferably, the first part 54 and the second part 56 are substantially identical, such that each of the parts 54, 56 has a half-cylinder shape.

The first part 54 is connected to the second part 56.

For example, as shown in FIG. 3, the first part 54 is connected to the second part 56 by a screw-nut system.

Alternatively, a clipping system, or "male"-"female" embedding system can also be considered.

According to one embodiment, the first part 54 is configured to be connected to the second part 56 by a "male"-"female" embedding system in a direction perpendicular to the axial direction Z.

Alternatively, the system providing the mechanical connection between the first part 54 and the second part 56 also makes it possible to establish an electrical connection between the regulating member 40 and the storage member 38. To that end, for example, each of the parts 54 and 56 includes a conducting track portion, the two conducting track portions forming a conducting track by establishing the mechanical connection.

When the first part 54 and the second part 56 are connected, the body 44 defines a central recess 58 with a shape complementary to the tower 12.

Alternatively, the recess 58 is defined by only one of the two parts 54, 56, for example the second part 56.

The body 44 is made from a plastic material.

According to another example, the body 44 is made from metal, for example steel or aluminum.

According to another example, the ring 44 is made from a flexible material, such as rubber or resin.

The upper part 48 includes a seal.

The seal is made from a material such as a flexible rubber sheet, a rubber profile or a silicone seal.

The median part 52 includes the light-emitting member 42, a first protective wall 62 of the light-emitting member 42, seals of the protective wall 64 and a protective wall 66 of the management member.

Alternatively, the median part 52 includes at least two light-emitting members 42 and at least one protective wall of the light-emitting members 42. In some cases, the median part 52 can be resized so as to protect all of the light protection members 42.

According to another alternative, the protective wall 62 includes images or inscriptions, said images or inscriptions corresponding to information to be brought to users' attention.

The first protective wall 62 is made from a polycarbonate material.

The first protective wall 62 is alternatively made from glass.

According to another example, the first protective wall 62 is made with a transparent resin.

The second protective wall 66 is made from plastic; the plastic may or may not be opaque.

Alternatively, the second protective wall 66 is made from polycarbonate.

According to another example, the second protective wall 66 is made from glass.

According to still another example, the second protective wall 66 is made from metal, such as steel or aluminum.

The storage member 38 is able to store the electric energy generated by the electric unit 16.

For example, the storage member 38 is a lithium-ion battery.

The capacity of the storage member 38 is determined based on the energy needs of the light unit 18.

The capacity of the storage member 38 is for example 2000 mAh (milliampere hours).

The regulating member 40 is able to regulate the charge of the storage member 38.

As an example, the regulating member 40 is able to measure the state of charge (SOC) of a battery.

The light-emitting member 42 is supplied by the storage member 38.

According to the example of FIG. 1, the light-emitting member 42 extends over the periphery of the housing 36.

According to the example of FIG. 1, the light-emitting member 42 is a strip light extending over practically the entire periphery of the housing 36, with the exception of the location where a seal is located providing sealing.

For example and non-exhaustively, the light-emitting member 42 is a set of light-emitting diodes (LED).

For example, the light-emitting diodes are distributed along a line surrounding the tower 12 around the axial direction Z. According to one embodiment, the line defines a planar disc perpendicular to the axial direction Z.

According to one embodiment, the light-emitting diodes are angularly evenly distributed along the line, i.e., each light-emitting diode is equidistant from the two closest light-emitting diodes. In other words, each angle formed by two consecutive light-emitting diodes and the axis of the tower 12 is equal to each other angle thus formed.

The light-emitting diodes are for example distributed along the periphery of the housing 36 so as to surround the tower 12 over 360 degrees. Thus, irrespective of the orientation of the housing 36 around the axial direction Z relative to an observer, at least one light-emitting diode is visible to the observer at each moment.

Alternatively, the light-emitting diodes are distributed along at least two lines surrounding the tower 12 around the axial direction Z.

For example, the light-emitting diodes are angularly evenly distributed along each line. The angle formed by two consecutive light-emitting diodes of a same line and the axis of the tower 12 has an angle value. The angle value is for example identical for each considered line. Alternatively, the angle value associated with at least one line is different from the angle value associated with at least one other line.

According to one embodiment, the light-emitting diodes of each line are distributed along part of the periphery of the housing 36.

For example, the light-emitting diodes of each line are distributed over an angle comprised between 60 degrees and 180 degrees. This means that the angle formed by a first segment traversing a first light-emitting diode belonging to a line and the axis of the tower 12 and a second segment traversing a second light-emitting diode belonging to the same line and the axis of the tower 12, the two considered light-emitting diodes being the light-emitting diodes forming the largest angle between them, is comprised between 60 degrees and 180 degrees.

The device 14 is then suitable for directional signaling. This means that the light-emitting diodes are only visible for certain orientations of the housing 36 relative to the observer.

The operation of the device 14 will now be described.

During operation, the device 14 is completely autonomous, since during the day, the sun illuminates the photovoltaic module 20. The photovoltaic module 20 converts the light energy from the sun into electric energy.

The electric energy produced by the photovoltaic module 20 is next stored in the storage member 38.

When lighting is desired (for example, at night), the storage member 38 supplies the light-emitting member 42. The light-emitting member 42 then emits light.

The device 14 has the advantage of having a relatively low mass. The total mass of the device 14 is below 5 kilograms, typically around four kilograms.

The power supply of the light-emitting member 42 is furthermore autonomous and renewable, since it uses solar energy.

The device 14 further adapts to any type of tower 12 with any shape (cylinder with circular base, oval base or polygonal base).

Furthermore, the device 14 can be mounted at any height.

The placement of such a device 14 does not cause any impact and/or any deterioration for the tower 12 on which the device 14 is installed.

The light is captured by the photovoltaic module 20 irrespective of the orientation of the photovoltaic module 20 on the tower 12.

Furthermore, the beacon and the light contrast are visible for any position of the person looking at the system 10.

Furthermore, the device 14 is protected with respect to outside attacks, in particular owing to the various walls.

Furthermore, the installation and uninstallation on the tower 12 are easy, which makes the device 14 easy to maintain.

As an example, this easy installation and/or uninstallation can be illustrated with a method for installing the device on the tower 12.

For example, such a method comprises the following steps: winding the photovoltaic module 20 on the tower 12, assembling the two parts 54 and 56 of the housing 36 and tightening the housing 36 on the tower 12, electrically connecting the storage member 38 contained in one of the two parts 54 and 56 of the housing 36 with the regulating member 40 contained in the other part 54 and 56 of the housing 36.

The method also includes a step for generating an electrical connection between the photovoltaic module 20 and the regulating member 40, generating an electrical connection between the light-emitting member 42 and the regulating member 40, assembling the maintaining support 22, fastening the support 22 in the housing 36 and tightening the ring(s) 30 that are part of the support.

It then clearly appears that such a method is implemented much more easily than the methods of the state of the art inasmuch as only elements specific to the device 14 are incorporated in the installation of the device 14 on the tower 12.

Furthermore, the device 14 has the advantage of being easily configurable.

Such configurability in particular allows an evolution of the device 14. Depending on the case, such an evolution assumes different forms. In particular, a change to the number of lighting units 18 can be considered, each lighting unit being able to perform different functions. Typically, one lighting unit 18 performs a beacon function while another lighting unit 18 performs an information lighting function.

According to another example, a change to the number of electrical units 16 makes it possible to adapt to the energy needs of the lighting unit(s) 18. Such an adaptation proves useful in particular in the case of addition of a lighting unit 18 or initial under-dimensioning of the energy needs of the lighting unit(s) 18 of the device 14.

The configurability of the device 14 is for example illustrated using FIGS. 5 to 7.

In the example of FIG. 5, the device 14 includes two electrical units 16 instead of a single electrical unit 16, such as for the example of FIG. 1.

In the illustrated configuration, the lighting unit 18 is arranged between the two electrical units 16.

In the example of FIG. 6, the device 14 also includes two electrical units 16 instead of a single electrical unit 16 as for the example of FIG. 1.

In the illustrated configuration, the two electrical units 16 are arranged on the same side relative to the lighting unit 18.

In the example of FIG. 7, the device 14 includes two lighting units 18 instead of a single lighting unit 18 as for the example of FIG. 1.

In the illustrated configuration, the electrical unit 16 is arranged between the two lighting units 18.

Such configurability of the device 14 is made possible by the fact that the different units 14 and 16 can be combined by embedding a protruding part of one unit 14, 16 in a corresponding groove of another unit 14, 16.

As previously explained, the configurability of the device 14 makes it possible to adapt easily to changes of needs by using the device 14 already in place on the tower 12. For example, the changes of needs correspond to a change in function of the tower 12 and/or a change of energy needs. The adaptation to a new need can be done by a simple evolution of the device 14. For example, an additional lighting unit 18 is added to increase the quantity of light generated.

Furthermore, according to one alternative, the device 14 includes a plurality of light-emitting members, one of these light-emitting members being the light-emitting member 42 extending over the periphery of the housing 36.

FIG. 8 illustrates another example embodiment of a device 14 according to the invention. The elements identical to the first embodiment of FIG. 1 are not described again. Only the differences are shown.

The upper part 48 has an outer face 68 and an inner face 70.

The upper part 48 is defined, in a plane perpendicular to the axial direction Z, by the outer face 68 and by the inner face 70.

The upper part 48 includes a first track 72, a second track 74, a first connector 76, a second connector 78 and a seal 79.

Among the outer face 68 and the inner face 70, the inner face 70 is the face closest to the tower 12 when the beacon device 14 is installed on the tower 12.

If the tower 12 is cylindrical, when the beacon device 14 is installed on the tower 12, the inner face 70 is in contact with the tower 12.

The inner face 70 has a first portion 80, a shoulder 82 and a second portion 84.

Among the first portion 80 and the second portion 84, the first portion 80 is the closest to the median part 52 along the axial direction Z.

If the tower 12 is cylindrical, the first portion 80 is provided to bear against the tower 12 when the device 14 is installed on the tower 12.

For example, the first portion 80 is cylindrical with a circular base, and the generatrix of the first portion 80 is parallel to the axial direction Z.

A first diameter D1 is defined for the first portion 80. The first diameter D1 is for example comprised between 70 mm and 300 mm.

The shoulder 82 is defined, in a plane perpendicular to the axial direction Z, by the first portion 80 and the second portion 84.

In the case of a cylindrical part, "shoulder" refers to a change in section of the part showing a surface perpendicular to the generatrix of the part.

The shoulder 82 is annular with a cylindrical base, i.e., the shoulder 82 is a planar surface defined by two coplanar and concentric circles with different diameters. The shoulder 82 is perpendicular to the axial direction Z.

The shoulder 82 is provided so that, when the photovoltaic module 20 and the lighting unit 18 are installed on the tower 12, the proximal end 26 of the photovoltaic module 20 is bearing against the shoulder 82 along the axial direction Z.

Among the first portion 80 and the second portion 84, the second portion 84 is the furthest from the median part 52 along the axial direction Z.

The second portion 84 is cylindrical with a circular base, and the generatrix of the second portion 84 is parallel to the axial direction Z.

A second diameter D2 is defined for the second portion 84.

The second diameter D2 is strictly larger than the first diameter D1. The second diameter D2 is for example comprised between 75 mm and 310 mm.

The second portion 84 is defined, along the axial direction Z, by the shoulder 82 and the seal 79.

The second position 84 is configured so that when the photovoltaic module 20 and the lighting unit 18 are installed on the tower 12, the proximal end 26 of the photovoltaic module 20 is surrounded by the second portion 84 in a plane perpendicular to the axial direction Z.

The first track 72 is an electrically conductive strip. For example, the first track 72 is made from a metal material such as copper. Alternatively, the first track 72 is made from another conducting material, such as aluminum or silver.

The first track 72 is supported by the second portion 84.

The first track 72 has a first length L1, a first width l1 and a first thickness e1.

The first length L1 is measured along a perimeter of the second portion 84. In other words, the first length L1 is the length, measured by a curved integral, of the orthogonal projection of the first track 72 over a plane perpendicular to the axial direction Z.

The first length L1 is greater than or equal to half the product of the second diameter D2 and the number $\pi$.

The first width l1 is measured along the axial direction Z. The first width l1 is uniform, i.e., the first width l1 is identical at all points of the first track 72. The first width l1 is comprised between 2 mm and 10 mm.

The first thickness e1 is measured along a radial direction. "Radial direction" refers to a direction perpendicular to the axis of the second portion 84 and parallel to a segment traversing the axis of the second portion 84 and the point at which the thickness is measured. The first thickness e1 is uniform. The first thickness e1 is comprised between 0.5 mm and 2 mm.

According to one embodiment, the first track 72 is compliant with the second portion 84, i.e., the first track 72 is in contact with the second portion 84 and marries the shape of the second portion 84.

For example, the first track 72 is cylindrical with an annular base, the axis of the first track 72 being parallel to the axial direction Z.

The axis of a cylinder with an annular or circular base is defined as being a straight line parallel to the generatrix of the cylinder and traversing the center of the circle or ring that forms the guide curve of the cylinder.

The first track 72 is for example formed by two track portions each supported by one of the first part 54 and the second part 56.

The second track 74 is an electrically conductive strip. For example, the second track 74 is made from a metal material such as copper. Alternatively, the first track 72 is made from another conducting material, such as aluminum or silver.

The second track 74 is supported by the second portion 84.

The second track 74 has a second length L2, a second width l2 and a second thickness e2.

The second length L2 is measured along a perimeter of the second portion 84. In other words, the second length L2 is the length, measured by a curved integral, of the orthogonal projection of the second track 74 over a plane perpendicular to the axial direction Z.

The second length L2 is greater than or equal to half of the product of the second diameter D2 and the number $\pi$, approximately equal to 3.14.

The second width l2 is measured along the axial direction Z.

The second width l2 is uniform, i.e., the second width l2 is identical at all points of the second track 74. The second [width] l2 is comprised between 2 mm and 10 mm.

The second thickness e2 is measured in a direction perpendicular to the axial direction Z. The second thickness e2 is uniform. The second thickness e2 is comprised between 0.5 mm and 2 mm.

The second track 74 is compliant with the second portion 84. For example, the second track 74 is cylindrical with an annular base, the axis of the second track 74 being parallel to the axial direction Z.

The second track 74 is, for example, formed by the meeting of two track portions each supported by one of the first part 54 and the second part 56.

The second track 74 is inserted between the first track 72 and the shoulder 82.

The second track 74 is not electrically connected to the first track 72.

For example, the first track 72 and the second track 74 are parallel to one another, and the distance between the first track 72 and the second track 74, measured along the axial direction Z, is greater than or equal to 1 mm.

The first connector 76 is configured to electrically connect the first track 72 to the storage member 38 or the regulating member 40.

The second connector 78 is configured to electrically connect the second track 74 to the storage member 38 or the regulating member 40.

The seal 79 is configured to isolate the first track 72 and the second track 74 from the outside of the upper part 48.

The seal 79 is configured to provide sealing between the upper part 48 and the photovoltaic module 20. In particular, the seal 79 is configured to prevent the water flowing downward along the outside of the photovoltaic module 20 from reaching the first track 72 or the second track 74.

The photovoltaic module 20 includes a positive electrode and a negative electrode.

The photovoltaic module 20 is configured to impose a difference in electrical potential, when the photovoltaic module 20 is illuminated by the sun, between the positive electrode and the negative electrode.

The proximal end 26 has been shown in transparency in FIG. 8.

The support 22 includes a third connector 86 and a fourth connector 88.

Each of the third connector 86 and the fourth connector 88 is fastened to the support 22. For example, each of the third connector 86 and the fourth connector 88 is glued to the support 22. Alternatively, each of the third connector 86 and the fourth connector 88 is embedded in a rigid part of the support 22.

The third connector 86 is configured to electrically connect the first track 72 to one from among the positive electrode and the negative electrode.

The fourth connector 88 is configured to electrically connect the second track 74 to the other from among the positive electrode and the negative electrode.

For example, each of the third connector 86 and the fourth connector 88 is connected to the corresponding electrode by a cable. The connecting cable is for example welded to the connector 86, 88 and the corresponding electrode.

Alternatively, each of the third connector 86 and the fourth connector 88 is connected to the corresponding electrode by a flexible printed circuit.

The third connector 86 and the fourth connector 88 are each configured to allow a relative rotation of the photovoltaic module 20 and its support 22 relative to the upper part 48 around the axial direction Z.

For example, each of the third connector 86 and the fourth connector 88 is configured to be elastically deformable during a relative rotation of the photovoltaic module 20 and the upper part 48 around the axial direction Z.

According to the example of FIG. 8, each of the third connector 86 and the fourth connector 88 is made from a rectangular metal tongue bent to form a book.

Each of the third connector 86 and the fourth connector 88 is made from a metal material. For example, each of the third connector 86 and the fourth connector 88 is made from a conductive material. The conductive material is for example chosen from the set consisting of copper, silver and aluminum.

Each of the third connector 86 and the fourth connector 88 includes a third portion 90, a fourth portion 92, a fifth portion 94 and a sixth portion 96.

Each of the third connector 86 and the fourth connector 88 has a width, measured along a perimeter of the second portion 84, comprised between 2 mm and 10 mm.

Each third portion 90 is parallelepiped. The third portion has a length, measured along the axial direction Z, comprised between 20 mm and 50 mm.

When the photovoltaic module 20 and the lighting unit 18 are installed on the tower 12, each third portion 90 is inserted between the proximal end 26 and the tower 12.

Each fourth portion 92 is parallelepiped.

Each fourth portion 92 is defined by the third portion 90 and the fifth portion 94.

Each fourth portion 92 is perpendicular to the corresponding third portion 90. Each fourth portion 92 is perpendicular to the axial direction Z.

Each fourth portion 92 has a length, measured in a radial direction, comprised between 2 mm and 10 mm.

When the photovoltaic module 20 and the lighting unit 18 are installed on the tower 12, each fourth portion 92 is inserted between the proximal end 26 and the shoulder 82.

When the photovoltaic module 20 and the lighting unit 18 are installed on the tower 12, each fifth portion 94 is inserted between the proximal end 26 and the second portion 84.

Each fifth portion 94 is defined by a first edge 98 and a second edge 100.

Each first edge 98 belongs both to the corresponding fourth portion 92 and fifth portion 94.

Each second edge 100 belongs both to the corresponding fifth portion 94 and sixth portion 96.

For each third connector 86 and each fourth connector 88, the point furthest from the axis of the second portion 84 in the radial direction belongs to the corresponding second edge 100. In other words, a segment contained in a plane containing the axis of the second portion 84 and connecting the first edge 98 to the second edge 100 forms, with a segment of the fourth portion 92 contained in the same plane, an angle strictly larger than 90 degrees. The considered angle is then the smallest of the two angles defined by the two considered segments.

Each second edge 100 bears against one from among the first track 72 and the second track 74.

The fifth portion 94 defines, with the respective third portion 90, fourth portion 92 and sixth portion 96, a convex volume at least partially surrounding the proximal end 26.

The sixth portion 96 has an end. The end of the sixth portion 96 is opposite the second edge 100.

The sixth portion 96 is defined by the second edge 100 and by the end of the sixth portion 96.

The end of the sixth portion 96 bears against the proximal end 26.

Each sixth portion 96 is therefore configured to electrically connect the corresponding electrode and the corresponding track 72, 74.

The sixth portion 96 and the fifth portion 94 are configured so that, when the photovoltaic module 20 and the lighting unit 18 are installed on the tower 12, the sixth portion 96 and the fifth portion 94 exert an elastic force tending to press the second edge 100 against the corresponding track 72, 74.

For example, when the photovoltaic module 20 and the lighting unit 18 are installed on the tower 12, each of the first track 72 and the second track 74 exerts a corresponding force on the second edge 100 causing an elastic deformation of the corresponding sixth portion 96 and fifth portion 94.

The device 14 then allows a relative rotation between the lighting unit 18 and the photovoltaic module 20, while preserving an electrical connection between them.

The device 14 therefore makes it possible to modify the orientation of the photovoltaic module 20, in particular to orient the latter favorably relative to the sun, without modifying the orientation of the lighting unit 18.

Furthermore, the electrical connection between the photovoltaic module 20 has a smaller bulk and is easy to produce, since it does not assume connecting power cables: simply positioning the proximal end 26 against a shoulder 82 makes it possible to cause the electrical connection between the photovoltaic module 20 and the lighting unit 18.

A third example embodiment of the device 14 according to the invention is shown in FIG. 9. The elements identical to the second embodiment of FIG. 8 are not described again. Only the differences are shown.

The second portion 84 includes a first rod 102 and a second rod 104.

Each rod 102, 104 is a continuous strip of material extending from the second portion 84 toward the tower 12 when the lighting unit 18 is installed on the tower 12.

According to one embodiment, each rod 102, 104 surrounds the tower 12 over at least 180 degrees.

Each rod 102, 104 for example has a parallelepiped section.

The first rod 102 is inserted between the first track 72 and the second track 74.

The rods 102, 104 are configured to cooperate with one another to guide the third connector 86 during a relative rotation between the lighting unit 18 and the photovoltaic module 20, such that the third connector 86 remains in electrical contact with the first track 72 during the rotation.

The first rod 102 is further configured to cooperate with the shoulder 82 to guide the fourth connector 88 during a relative rotation between the lighting unit 18 and the photovoltaic module 20, such that the fourth connector 88 remains in electrical contact with the first track 74 during the rotation.

Each of the third connector 86 and fourth connector 88 is cylindrical with a circular base, and the generatrix of each of the third connector 86 and fourth connector 88 is parallel to a radial direction of the second portion 84.

Each of the third connector 86 and the fourth connector 88 has a diameter comprised between 2 mm and 10 mm.

Each of the third connector 86 and the fourth connector 88 has a base 106 and a contact end 108. Each of the third connector 86 and the fourth connector 88 is defined in a radial direction of the second portion 84 by the base 106 and the contact end 108.

Each base 106 is configured to fasten the corresponding connector 86, 88 to the proximal end 26.

Each contact end 108 is hemispherical. Each contact end 108 is provided to bear against the corresponding track 72, 74 when the photovoltaic module 20 and the lighting unit 18 are installed on the tower 12.

The rods 102 and 104 then allow stronger securing of the electrical unit 16 to the lighting unit 18. The rods 102 and 104 contribute to keeping the module 20 and its support 22 in position relative to the housing 36.

Furthermore, the rods 102 and 104 also allows better maintenance in position of the third and fourth connectors 86 and 88, and therefore a more reliable electrical connection between the third and fourth connectors 86 and 88 and the tracks 72 and 74.

The connection surface between the third and fourth connectors 86 and 88 and the tracks 72 and 74 is also enhanced.

According to another example device 14, the device includes a tightening band provided to grip the tower 12. When the tightening band is gripping the tower 12, the tightening band for example forms a support for the housing 36.

The device 14 is then particularly suitable for being fastened to a non-cylindrical tower, in particular a conical tower.

The invention claimed is:

1. A lighting device to be installed on a tower, the device including:

an electric energy generating unit comprising:

at least one photovoltaic module able to be wound over at least part of the circumference of the tower, and a light energy generating unit configured to be fastened on the tower, the light energy generating unit comprising:

a housing having a periphery including an outer circumferential surface that extends in a longitudinal direction of the tower, the housing comprising a body having an upper part, a lower part, and a median part defined by the upper part and the lower part, the upper part including a first electric track and a second electric track, the second electric track having a uniform width, the width being comprised between 2 millimeters and 10 millimeters, and the second electric track having a uniform thickness, the thickness being comprised between 0.5 millimeters and 2 millimeters, a storage member storing the electric energy generated by the electric energy generating unit, a regulating member regulating the charge of the storage member, and a light-emitting member supplied by the storage member, the light-emitting member extending circumferentially about the outer circumferential surface of the periphery of the housing, the first and second electric tracks being used to power the light-emitting member.

2. The device according to claim 1, wherein the housing comprises the storage member and the regulating member.

3. The device according to claim 1, wherein the housing has a recess with a shape complementary to the tower.

4. The device according to claim 1, wherein the housing has two parts, the second part being connected to the first part.

5. The device according to claim 1, wherein the electric energy generating unit includes a support keeping the photovoltaic module wound over at least part of the circumference of the tower.

6. The device according to claim 5, wherein the support comprises a ring and two maintaining elements connecting the ring to the light energy generating unit, the two maintaining elements being diametrically opposite one another.

7. A beacon system, comprising:

a tower, and a device according to claim 1 installed on the tower.

8. A beacon system, comprising:

a tower, at least one electric energy generating unit comprising:

at least one photovoltaic module able to be wound over at least part of the circumference of the tower, and at least one light energy generating unit configured to be fastened on the tower, each light energy generating unit comprising:

a housing having a periphery including an outer circumferential surface that extends in a longitudinal direction of the tower, the housing comprising a body having an upper part, a lower part, and a median part defined by the upper part and the lower part, the upper part including a first electric track and a second electric track, the second electric track having a uniform width, the width being comprised between 2 millimeters and 10 millimeters, and the second electric track having a uniform thickness, the thickness being comprised between 0.5 millimeters and 2 millimeters, a storage member storing electric energy generated by an electric energy generating unit, a regulating member regulating the charge of the storage member, and a light-emitting member supplied by the storage member, the light-emitting member extending circumferentially about the outer circumferential surface of the periphery of the housing, the first and second electric tracks being used to power the light-emitting member.

9. A method for installing a device according to claim 1 on a tower, comprising the following steps:

winding the photovoltaic module on the tower, and assembling the housing on the photovoltaic module.

10. The device according to claim 1, wherein the lightning device is a beacon device.

11. The device according to claim 1, wherein the at least one photovoltaic module able to be wound over the entire circumference of the tower.

12. A beacon system according to claim 9, wherein the at least one photovoltaic module able to be wound over the entire circumference of the tower.

13. The device according to claim 5, wherein the at least one photovoltaic module able to be wound over the entire circumference of the tower.

14. The device according to claim 1, wherein the upper part has an inner face comprising two portions and a shoulder defined by said two portions, the second electric track being inserted between the first electric track and the shoulder.

15. The device according to claim 1, the upper part having an inner face comprising a first portion and a second portion, the second portion including a first rod and a second rod, each of the first and second rods surrounding the tower over at least 180 degrees.

16. The device according to claim 15, wherein the electric energy generating unit includes a support keeping the photovoltaic module wound over at least part of the circumference of the tower, and wherein the support comprises a first connector and a second connector, the first and second rods being configured to cooperate with one another to guide the first connector during a relative rotation between the lighting unit and the photovoltaic module such that the first connector remains in electrical contact with the first electric track during the rotation, the first rod being further configured to cooperate with the shoulder to guide the second connector during the relative rotation between the lighting unit and the photovoltaic module such that the second connector remains in electrical contact with the first electric track during the rotation.

17. The device according to claim 1, further comprising a tightening band provided to grip the tower, the tightening band forming a support for the housing when the tightening band is gripping the tower.

* * * * *